US005967845A

United States Patent [19]

Ho et al.

[11] Patent Number: 5,967,845

[45] Date of Patent: Oct. 19, 1999

[54] CARD CONNECTOR ASSEMBLY

[75] Inventors: Yu-Ming Ho, Pan-Chiao; Hung-Ji Yu, Hsi Chih Chen, both of Taiwan

[73] Assignee: Hon Hai Precision Ind. Co., Ltd., Taipei Hsien, Taiwan

[21] Appl. No.: 08/982,062

[22] Filed: Dec. 1, 1997

[30] Foreign Application Priority Data

Nov. 30, 1996 [TW] Taiwan ..... 85218633

[51] Int. Cl.[6] ..... H01R 13/648

[52] U.S. Cl. ..... 439/607; 439/64; 439/540

[58] Field of Search ..... 439/64, 108, 607, 439/76.1, 540

[56] References Cited

U.S. PATENT DOCUMENTS 4,389,080 6/1983 Clark et al. ..... 439/64
5,174,771 12/1992 Burgit et al. ..... 439/108
5,231,274 7/1993 Reynier et al. ..... 439/64
5,288,247 2/1994 Kaufman ..... 439/607
5,470,237 11/1995 Byczek et al. ..... 439/607
5,478,259 12/1995 Noschese ..... 439/607
5,816,827 10/1998 Nelson et al. ..... 439/64

*Primary Examiner*—Christopher A. Bennett

[57] ABSTRACT

A card connector assembly consisting of two stacked connectors for providing prevention of noise, each includes an interface housing connected with a guiding frame having a grounding plate connected thereto. A first conductive plate and a second conductive plate are respectively engaged with an upper periphery of the guiding frame of the upper connector and a lower periphery of the guiding frame of the lower connector. The first conductive plate and the second conductive plate are engaged in order to prevent noise from acting on an electrical card received in the card connector.

6 Claims, 3 Drawing Sheets

CARD CONNECTOR ASSEMBLY

BACKGROUND OF THE INVENTION

1. Field of the Invention

The present invention relates to a card connector assembly and particularly to the card connector assembly which reduces transmission errors due to noise and provides a function for dust settling prevention.

2. The Prior Art

Noise is inevitable during signal transmission between electrical devices connected by wires and connectors. The noise may result from electron static disturbance (ESD) or electromagnetic interference (EMI). ESD will exist on two device surfaces when sufficient particles settle thereon thus forming an electron static capacitor between the two devices which emits electron static electrons that interfere with the performance of the related devices and other peripherals. When two mating devices, such as an electrical card and a related card connector are abruptly connected together in a relatively dry environment, particles on the devices may cause an electron static discharge and damage the components within the electrical card. Noise can also result from an EMI which is related to an electric current flowing through the devices. Prior art which prevents noise from affecting the card connector are disclosed in U.S. Pat. Nos. 4,818,239; 4,878,856; 4,810,203; 5,085,590; 5,149,276; 5,176,523; 5,334,046. However, the prior art only addresses on the prevention of the ESD at the insertion opening of the connector while virtually neglecting the prevention of the EMI. More specifically, the prior art merely provides a grounding plate at two distal ends of the guiding bracket near the insertion opening of the card connector. This structure can eliminate ESD upon insertion of the electric card into the card connector but the EMI will continue to affect the operation of the electrical card. If the electrical card and an interface of the card connector having pins projected therethrough are not isolated or protected with a sufficient metal shield, these portions will be affected by EMI. Another drawback of the prior art is that the two guiding brackets are exposed to the outside environment, therefore noise will affect the assembly of the electrical card and the card connector. Additionally, dust is apt to gather on the card-connector assembly due to an insufficient metal shield thus causing ESD.

Therefore, an improved card connector is required to eliminate the above drawbacks of the prior art especially one which can considerably eliminate problems resulting from ESD and EMI.

SUMMARY OF THE INVENTION

The primary purpose of the present invention is to provide an improved card connector having an excellent shielding effect which prevents noise from interfering with the normal signal transmission of the card connector.

In accordance with one aspect of the present invention, a card connector assembly consists of two stacked connectors for receiving two electrical cards, wherein each connector comprises an interface housing having contacts projecting therefrom, a guiding frame connected with the interface housing for guiding the insertion of the electrical card, a grounding plate for covering the interface housing, a first conductive plate including a first engaging means projecting from a periphery thereof for engaging with an upper periphery of the guiding frame of the upper connector, and a second conductive plate including a second engaging means projecting from a periphery thereof for engaging with a lower periphery of the guiding frame of the lower connector, and wherein the first engaging means of the first conductive plate engages with the periphery of the second conductive plate. Thus, the first conductive plate together with the second conductive plate prevents EMI and ESD from acting on the electrical card.

DETAILED DESCRIPTION OF THE PREFERRED EMBODIMENTS

References will now be described in detail to the preferred embodiment of the invention.

Figure 1:
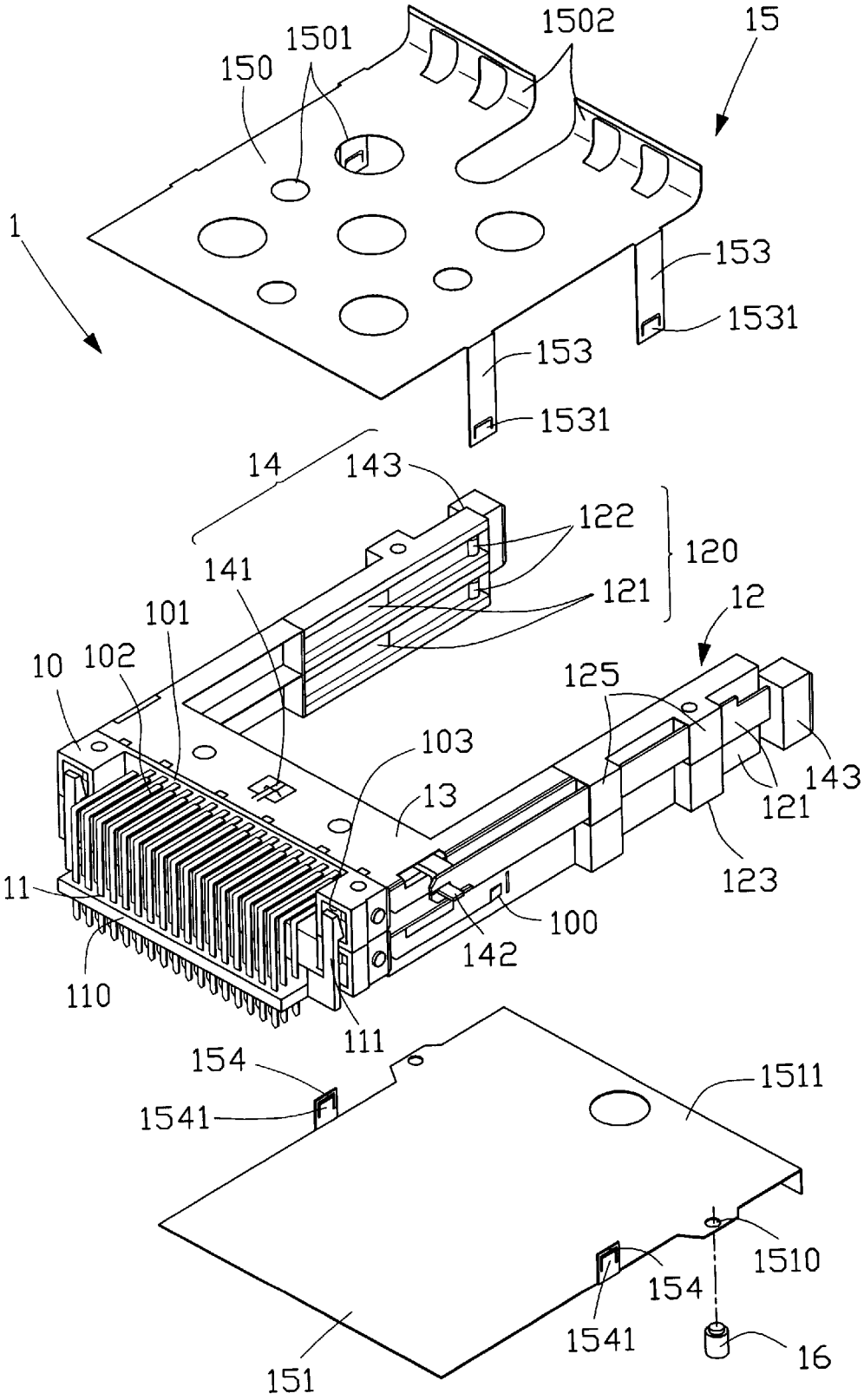
FIG. 1 is a perspective, exploded view of a card connector assembly in accordance with the present invention.

Referring to the drawings and initially to FIG. 1, a card connector assembly 1 in accordance with the present invention is of a two connectors stacked structure. Each connector of the card connector 1 comprises an interface housing 10, a plurality of right-angle contacts 11 projecting from holes 102 defined in a first surface 101 of the interface housing 10, a U-shaped guiding frame 12 connected to the interface housing 10, a grounding plate 13 covering an intermediate portion of the U-shaped guiding frame 12, and a shielding means 15 for covering the exposed portion of the U-shaped guiding frame 12.

The U-shaped guiding frame 12 includes an intermediate portion (not shown) and two guiding branches 120 extending from two distal ends of the intermediate portion, and connects to the interface housing 10 by means of an engaging metal plate 100. Each guiding branch 120 of the U-shaped frame 12 includes a guiding groove 121 which allows an electrical card (not shown) to be slid therethrough into/from a second surface (not shown) opposite a first surface 101 of the interface housing 10. A conductive plate 122 is attached within an end portion of the guiding groove 121 for absorbing and eliminating noise. Two hollow ears 125 are formed at an outside portion of the branch 120 for guiding the driving bar 143 to slide along the elongate direction of the guiding branch 120. The first surface 101 communicates with the second surface of the interface housing 10 via holes 102 defined therethrough. The contacts 11 extend through the holes 102 of the interface housing 10 and project beyond the second surface thereof for electrically connecting with corresponding contacts of the electrical card (not shown). The grounding plate 13 is engaged with the intermediate portion of the U-shaped guiding frame 12 for absorbing and eliminating electrostatic charges (particles) on the electrical card upon insertion thereof. An ejecting means 14 includes an ejecting plate 141 slidably received in a reception space defined between the U-shaped guiding frame 12 and the grounding plate 13, a transmission lever 142 having a first end pivotally connected to a central point of the ejecting plate 141, and a driving bar 143 pivotally connected to a second end of the transmission lever 142. Two hollow ears 125 are formed at an outside portion of the branch 120 for guiding the driving bar 143 to slide along the elongate direction of the guiding branch 120. Therefore, when the driving bar 143 is manually pulled away from the interface housing 10, the ejecting plate 141 retracts into the reception space before insertion of an electrical card (not shown). Likewise, when the driving bar 143 is pushed toward the interface housing 10, the ejecting plate 141 projects from the reception space thereby ejecting the electrical card (not shown).

A positioning plate 110 defining a plurality of apertures (not labeled) therein for isolating the contacts 11 is engaged with the interface housing 10 by means of two hooks 111 formed at opposing ends thereof which are respectively received in two receptacles 103 defined at two distal ends of the interface housing 10.

The shielding means 15 comprises a first conductive plate 150 having four engagement fingers 153 extending vertically from two opposite sides thereof, and a second conductive plate 151 having two engagement fingers 154 extending vertically from two sides thereof. The first conductive plate 150 and the second conductive plate 151 are sufficiently sized to respectively cover the upper portion of the guiding frame 12 of the upper connector and the lower portion of the guiding frame 12 of the lower connector, to protect the electrical card from being affected by EMI and to prevent electrostatic charges from gathering on the electrical card. A plurality of heat dissipation holes 1501 are defined in the first conductive plate 150 for facilitation of heat dissipation from both the card connector assembly 1 and the electrical cards. A curved lip 1502 formed at one edge of the first shielding plate 150 is electrically connected to an enclosure of a personal computer for further eliminating noise. The second shielding plate 151 has a pair of holes 1510 defined near two opposite sides thereof for receiving two conductive stand-offs 16 respectively which lock the second shielding plate 151 into corresponding holes 123 defined through the two guiding bars 120 thereby elevating the card connector assembly 1 and further grounding the shielding plate 151.

Figure 2:
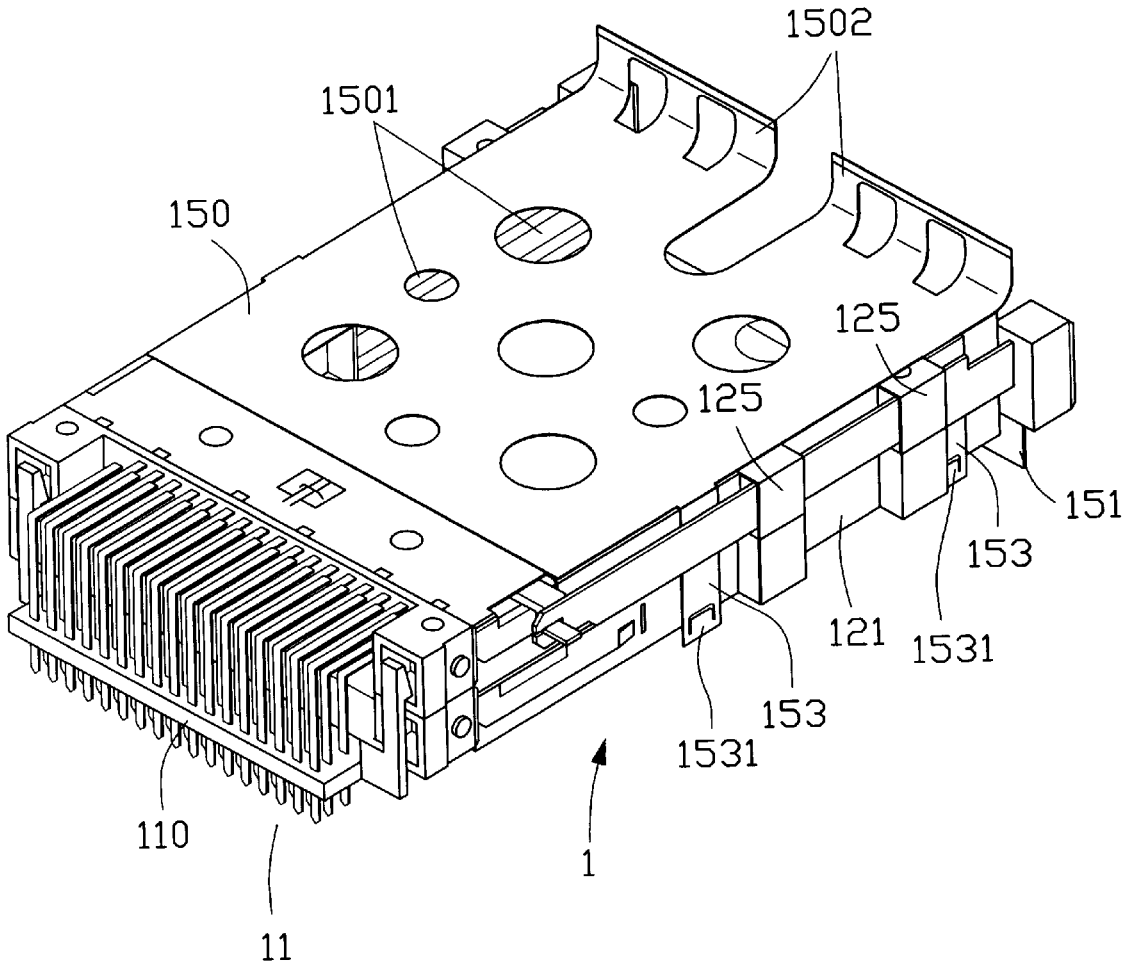
FIG. 2 is an assembled view of FIG. 1.
Figure 3:
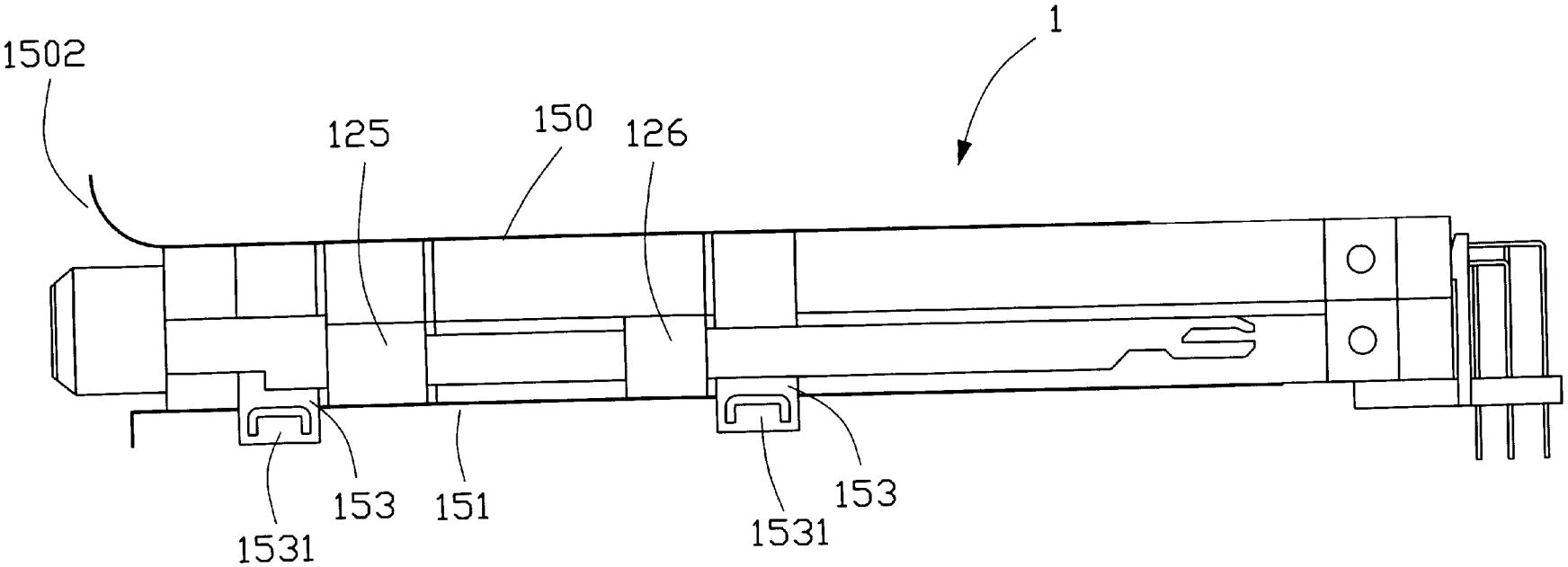
FIG. 3 is an elevational side view of FIG. 2.

Referring to FIGS. 2 and 3, each engagement finger 153 projects beyond the second shielding plate 151 and a tab 1531 is formed on a lower portion thereof for fixing the second shielding plate 151 when the first shielding plate 150 is engaged with the second shielding plate 151. The finger 154 extending from the second shielding plate 151 is also formed with a tab 1541 for engaging with the outer side of each guiding branch 120. All the conductive portions excluding the contacts in each layer of the connector 1 are electrically connected together for better grounding effect.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. A card connector assembly for connecting two electrical cards to a mother board, including an upper connector and a lower connector, each of said connectors including:

an interface housing comprising contacts projecting therefrom;

a guiding frame connected with the interface housing for guiding insertion of the electrical card;

a first conductive plate including first engaging means projecting from a first periphery thereof for engaging with an upper periphery of the guiding frame of the upper connector; and a second conductive plate including second engaging means projecting from a second periphery thereof for engaging with a lower periphery of the guiding frame of the lower connector; wherein the first engaging means of the first conductive plate engages with the second periphery of the second conductive plate for securing the first conductive plate and the second conductive plate together.

2. The connector assembly as defined in claim 1, wherein the first engaging means includes fingers each defining a tab for latchable engagement with the second periphery of the second conductive plate.

3. The connector assembly as defined in claim 1, wherein the first conductive plate includes one curved edge located away from the interface housing for electrically contacting with a metal enclosure of a personal computer for increasing the grounding area of the connector assembly.

4. The connector assembly as defined in claim 1, wherein one of the first conductive plate and the second conductive plate includes heat dissipation holes therein for facilitating the heat dissipation of the connector assembly.

5. A card connector assembly including an upper connector and a lower connector, each connector comprising:

an interface housing comprising contacts projecting therefrom;

a guiding frame connected with the interface housing for guiding insertion of an electrical card;

a first conductive plate including first engaging means projecting from a first periphery thereof for engaging with an upper periphery of the guiding frame of the upper connector; and a second conductive plate including second engaging means projecting from a second periphery thereof for engaging with a lower periphery of the guiding frame of the lower connector; wherein the first conductive plate has one curved edge located away from the interface housing for electrical contacting with a metal enclosure of a personal computer for increasing the grounding area of the card connector.

6. A card connector assembly including an upper connector and a lower connector, each connector comprising:

an interface housing comprising contacts projecting therefrom;

a guiding frame connected with the interface housing for guiding insertion of an electrical card;

a first conductive plate including first engaging means projecting from a first periphery thereof for engaging with an upper periphery of the guiding frame of the upper connector; and a second conductive plate including second engaging means projecting from a second periphery thereof for engaging with a lower periphery of the guiding frame of the lower connector; wherein each of the first conductive plate and the second conductive plate includes heat dissipation holes therein for facilitating the heat dissipation of the connector assembly.

* * * * *